United States Patent [19]

Wafer

[11] 3,991,391

[45] Nov. 9, 1976

[54] CIRCUIT INTERRUPTER WITH ELECTROMAGNETIC OPENING MEANS

[75] Inventor: John A. Wafer, Monroeville, Pa.

[73] Assignee: Westinghouse Electric Corporation, Pittsburgh, Pa.

[22] Filed: Sept. 5, 1974

[21] Appl. No.: 503,232

Related U.S. Application Data

[63] Continuation of Ser. No. 437,856, Jan. 29, 1974, abandoned.

[52] U.S. Cl. ..... 335/16; 335/170

[51] Int. Cl.[2] ..... H01H 77/02

[58] Field of Search ..... 335/16, 170, 174, 147, 335/195

[56] References Cited

UNITED STATES PATENTS

| | | | |
|---|---|---|---|
| 3,343,108 | 9/1967 | Murai | 335/16 |
| 3,444,490 | 5/1969 | Krummel et al. | 335/170 |
| 3,783,422 | 1/1974 | Taylor | 335/174 |
| 3,813,619 | 5/1974 | Koval | 335/16 |
| 3,815,059 | 6/1974 | Spoelman | 335/16 |
| 3,824,508 | 7/1964 | Terracol | 335/16 |

*Primary Examiner*—Harold Broome

*Attorney, Agent, or Firm*—W. A. Elchik

[57] ABSTRACT

A circuit interrupter characterized by a movable contact arm disposed between two spaced stationary contacts which arm is movable to the open position by electromagnetic forces generated by an overload current condition.

17 Claims, 7 Drawing Figures

CIRCUIT INTERRUPTER WITH ELECTROMAGNETIC OPENING MEANS

This is a continuation, of application Ser. No. 437,586 filed Jan. 29, 1974 now abandoned.

CROSS-REFERENCE TO RELATED APPLICATIONS

This invention is related to the inventions disclosed in the applications of John A. Wafer, Ser. No. 436,588, filed Jan. 25, 1974 and Paul Slade and John A. Wafer, Ser. No. 390,283, filed Aug. 21, 1973; all of which are assigned to the assignee of the instant application.

BACKGROUND OF THE INVENTION

1. Field of the Invention:

This invention relates to circuit interrupters and more particularly it pertains to a current-limiting breaker with a high-speed dual-break electromagnetic mechanism.

2. Description of the Prior Art:

It is known in the prior art to provide a circuit interrupter having an elongated current carrying contact arm in which an overload current generates electromagnetic forces to cause a magnetic device to drive the contact arm to an open position at high speed to provide current-limiting characteristics and to interrupt the overload current. An example of such a circuit interrupter is disclosed in U.S. Pat. No. 3,815,059 issued June 4, 1974 to Leonard A. Spoelman and assigned to the assignee of the present invention. One advantage of a magnetic-drive circuit interrupter in conjunction with a circuit breaker, such as the toggle type breaker, over current limiting fuse means is that the magnetic drive circuit interrupter can be reset and reused without requiring replacement of fuses.

SUMMARY OF THE INVENTION

Generally, it has been found in accordance with this invention that additional advantages may be obtained by providing a circuit interrupter comprising a circuit interrupter structure having a pair of spaced stationary contacts, movable contacts cooperable with said stationary contacts and mounted on a contact carrying arm, support means for the contact carrying arm and movable between closed and open positions of the contacts, the support means being located substantially centrally between the spaced stationary contacts, a magnetic drive structure having an open slot therein which slot is open at one end of the structure and closed at the other end thereof, the contact arm being positioned in the slot in proximity to the open end thereof, the support means comprising movable means for moving the contact arm to the closed position, the circuit through the circuit interrupter passing through the contact arm and the contacts in the closed position, and upon the occurrence of an overload current above a predetermined value through said contact arm the magnetic flux generated by the current in the contact arm operating in the magnetic device drives the contact arm to the closed end of the slot to thereby open the circuit through the contacts.

In another embodiment of the invention, latch means are provided which comprise a magnetic flux producing structure for holding the contact arm in the closed position, the force of the magnetic structure being greater than the force exerted by the magnetic drive structure below overload current of predetermined value.

An advantage of the current limiting circuit breaker is that a pair of contacts are open by a force induced by a fault current. Another advantage is that the current limiting breaker includes two tripping mechanisms, one of which is a magnetic flux transfer mechanism that provides the tripping action for lower current faults and the other of which is a self-induced force derived from a conductor in the slot of a soft magnetic yoke to provide tripping action for high current faults.

DESCRIPTION OF THE PREFERRED EMBODIMENTS

Figure 1:
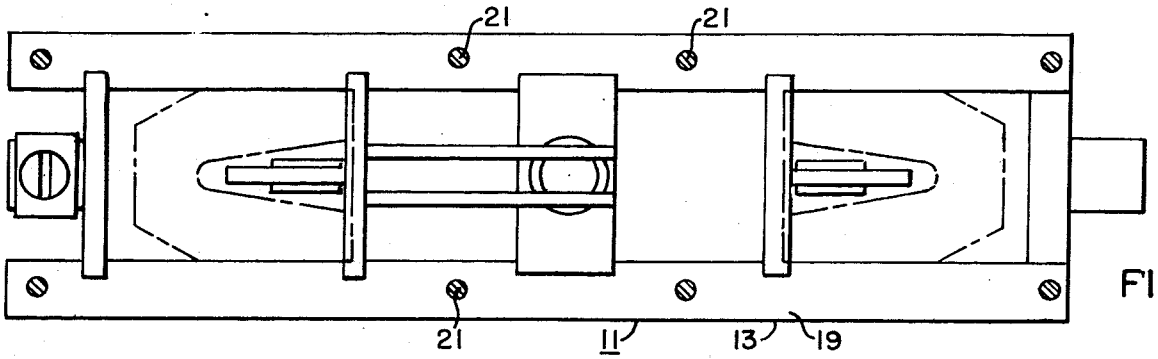
FIG. 1 is a top plan view of circuit interrupting structure constructed in accordance with the principles of this invention.
Figure 2:
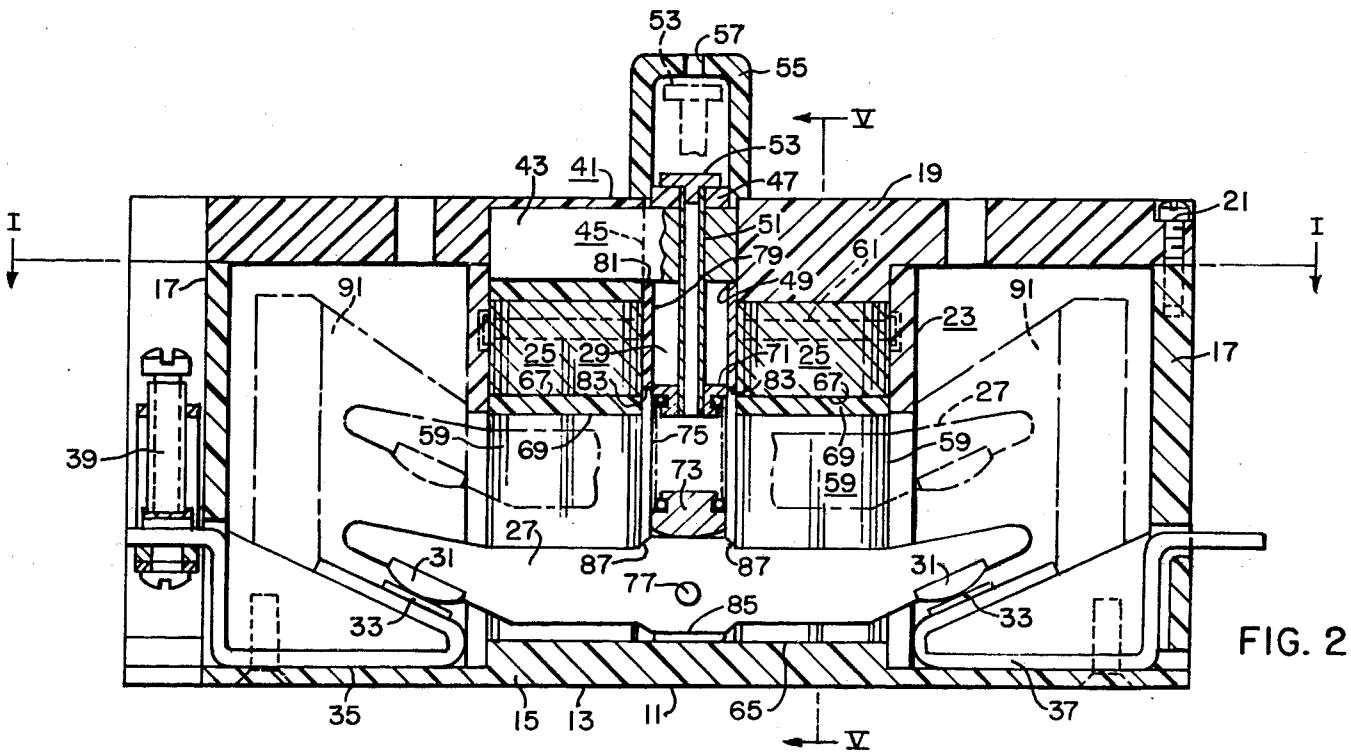
FIG. 2 is a vertical sectional view taken along the line II—II of FIG. 1.

In FIGS. 1 and 2 a circuit interrupter protective device is generally indicated at 11. Although the device 11 is disclosed as a single pole circuit interrupting device, it is understood that it may be used for a plurality of poles such as a three pole unit. More particulaly the the device 11 is a magnetic-drive circuit interrupter connected in electrical series with load and line leads of an electrical distribution system. The device 11 comprises an insulating housing 13 (FIG. 2) which includes a base 15, sidewalls 17, and a cover 19. The several parts of the housing are secured together by a plurality of screws, such as screw 21, between the cover 19 and the sidewalls 17.

A magnetic drive ciruit interrupter generally indicated at 23 is located substantially centrally of the housing 13 and comprises a magnetic device or magnetic slot motor 25, a contact arm 27, support means 29 for the contact arm, a pair of movable contacts 31, and stationary contacts 33. The stationary contacts 33 are mounted on spaced conductors 35 and 37, the outer end of which extend through openings in the sidewalls 17 at opposite ends of the device 11. A connector for connecting the device 11 to line and lead conductors (not shown) may be provided on the outer ends of the contacts 35 and 37, such as the terminal conductor 39, on the outer end of the conductor 35. Accordingly, a circuit through the device 11 extends through the conductor 35, the stationary contact 33, the movable contact 31, the contact arm 27, the movable contact 31, the stationary contact 33, and the conductor 37.

In addition, the magnetic drive circuit interrupter 23 includes a latch structure generally indicated at 41 and located at the upper end of the support means 29. The latch structure 41 comprises a permanent magnet 43, a pair of pole pieces 45 (only one of which is shown in FIG. 2), and a keeper 47. The pole pieces 45 are disposed on opposite sides of the magnet and extend across a vertical opening 49 within a magnetic device 25 and the cover 19. The pole pieces 45 are disposed on opposite sides of a shaft or tube 51 which is part of the support means 29. The upper end of the shaft 51 has a cap 53 which is enclosed within a cylindrical portion 55 of the housing to prevent inadvertent contact with the cap. The housing portion 55 is sufficiently high to enable the shaft 51 to rise when the device 11 is in the open circuit position, as shown by the broken line position of the contact arm 27 in FIG. 2. In order to lower the contact arm 27 to the closed circuit position an opening 57 is provided on the upper side of the housing portion 55, whereby an appropriate instrument may be inserted to depress the cap 53 and the shaft 51 to the lowermost positions.

Figure 5:
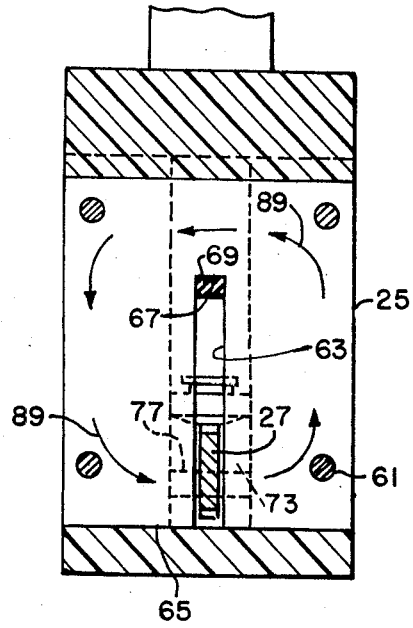
FIG. 5 is a vertical sectional view taken on line V—V of FIG. 2.

The magnetic slot motor 25 is a rectangular body comprised of a plurality of laminations of relatively thin plates 59 of soft magnetic material, such as iron or cold rolled steel, that are secured together in a surface-to-surface relationship. The body of plates 59 is retained together by a plurality of spaced means such as bolts 61 (FIG. 5). The magnetic slot motor 25 is a magnetic yoke formed of inverted U-shaped plates to provide a slot 63 (FIG. 5), the lower end of which is open at 65 and the upper end of which is closed at 67. Pads 69 composed of a resilent material, such as nylon, are mounted on the surfaces 67 to serve as bumpers for the contact arm 27 when it moves from the closed to the open circuit position as shown by the broken line position in FIG. 2.

The support means 29 comprise the shaft 51, a spring retainer 71, a shaft 73, a compression spring 75, and a pin 77. The central opening 49 includes a liner 79 of non-conducting material, such as Teflon, which liner is coextensive with the vertical length of the opening; that is, from the open lower end 65 to a location 81 above the top surface of the magnetic slot motor 25. The liner 79 has a pair of diametrically opposite slots 83 which are aligned with the slot 63 to accommodate movement of the contact arm 27. The contact arm 27 is pivotally mounted on the shaft 73 by the pivot pin 77 to enable the contacts 31 and 33 to maintain good electrical contact for which purpose an opening 85, in which the contact arm is mounted in the shaft 73, is bevelled at 87 to allow for slight rotation of the contact arm. This insures that the contact arm 27 will contact on each side though there is uneven wear of the contacts 31, 33.

The spring 75 is a compression spring which extends between the spring retainer 71 and the shaft 73, thereby holding the contact arm 27 tautly in the closed circuit position. It is understood, however, that the device would be operative if the shaft 51 were extended to a lower position where it would support the pivot pin 77 and thereby eliminate the need for the spring retainer 71, the shaft 73, and the spring 75. However, such a substitute construction would eliminate the advantage of the compression spring 75.

The latch structure 41 is the means by which the contact arm 27 is lowered and maintained in the closed circuit position with good electrical contact between the contacts 31 and 33. For that purpose magnetic forces created by the permanent magnet 43 pass through the pole pieces 45 and across the keeper 47 when the contact arm 27 is in the lowermost or closed circuit position. During periods of normal current condition the current passing through the contact arm 27 creates an encircling magnetic field, indicated by the arrows 89 in the magnetic slot motor 25 (FIG. 5). The force of the encircling magnetic field during normal current condition is such that the arm 27 remains in the closed circuit position. Upon the occurrence of a severe overload above a predetermined value, the magnetic forces generated by the current in the contact arm 27 overcome the magnetic forces generated by the permanent magnet 43 and between the pole pieces 45 and the keeper 47. As a result the increased electromagnetic forces in the magnetic slot motor 25 move the contact arm 27 upwardly within the slot 63, and thereby open the circuit through the contacts 31, 33. The device 11 also includes conventional arc chutes 91 around the contacts 31, 33.

Figure 3:
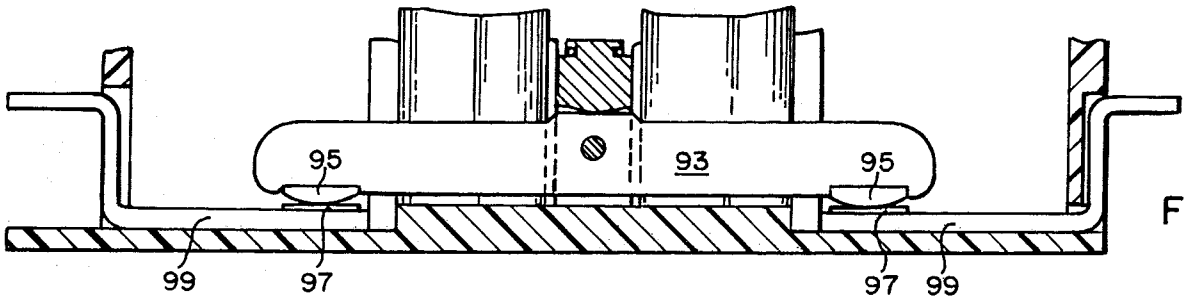
FIG. 3 is a vertical sectional view similar to that of FIG. 1, illustrating another embodiment of the invention.

Another embodiment of the invention is that shown in FIG. 3 in which a contact arm 93 of configuration different from the contact arm 27 is shown with movable contacts 95 at opposite end thereof. The movable contacts 95 engage stationary contacts 97 which are mounted on similar conductors 99 which also have a configuration different from the conductors 35, 37 of FIG. 2. In all other respects the device shown in FIG. 3 is substantially similar to that shown in FIG. 2.

Figure 4:
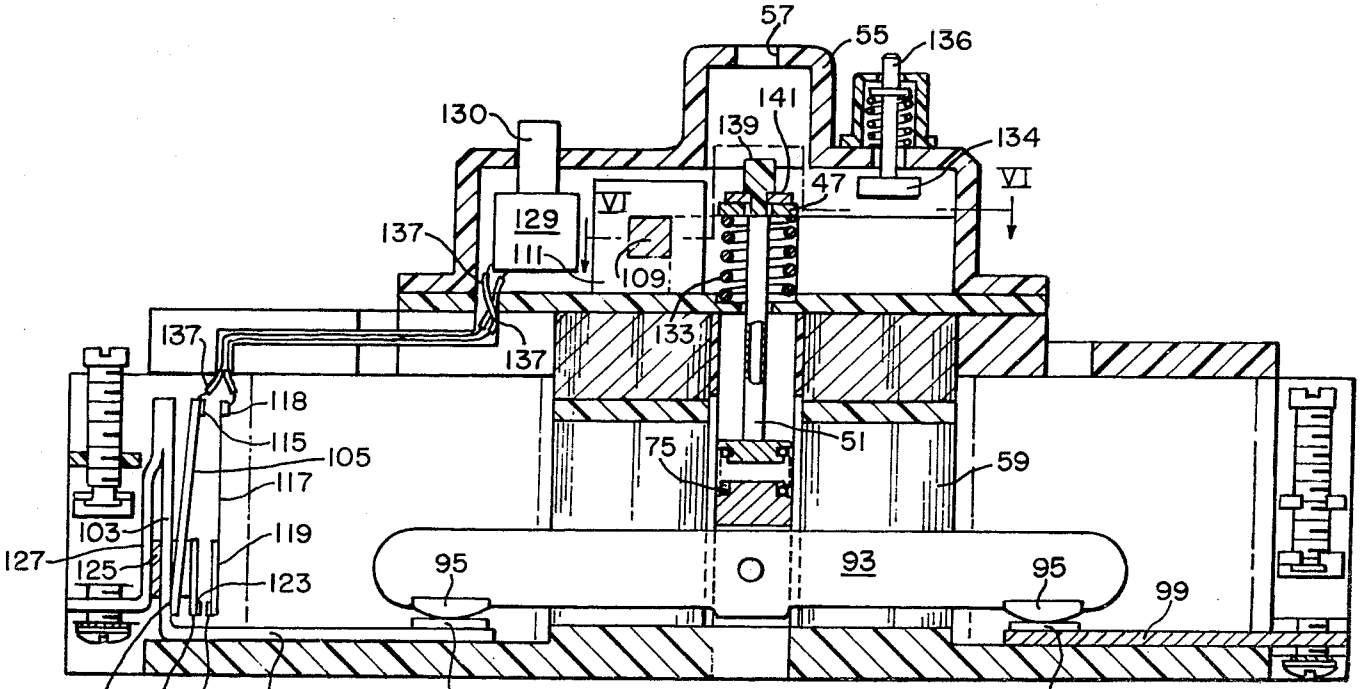
FIG. 4 is a vertical sectional view similar to that of FIGS. 2 and 3 illustrating a third embodiment of the invention.

Another embodiment of the invention is shown in FIG. 4 and for purposes of description only those parts which differ from the previous embodiments are described with additional reference numbers. The device of this breaker includes two tripping mechanisms, one for lower current faults and the other for high current faults. The circuit interrupter device of FIG. 4 comprises a conductor 101 having an upright portion 103, a bimetal element 105, an electromagnetic structure generally indicated at 107, and a keeper 109 surrounded by a coil 111. The lower end of the bimetal element 105 is mounted at 113 on the upright portion 103 of the conductor 101. The upper end of the bimetal element 105 may be provided with a contact 115 for engagement with the upper end of a conductor 117 which is fixedly mounted at the upper end. A corresponding contact 118 is disposed at the upper end of the conductor 117. The lower end of the conductor 117 includes an armature 119 and a contact 121 which cooperates with a contact 123 which is mounted on a U-shaped yoke or core 125. The core 125 in turn is mounted on an extension 127 of the conductor 101 and a core surrounds the upright portion 103 of the conductor. Any increase in current due to a low current fault activates the core sufficiently to attract the armature 119 to the left, whereby contact is made between the contact 121 and 123.

In addition a switch 129 is provided for manual or remote opening of the contacts 95, 97.

Figure 6:
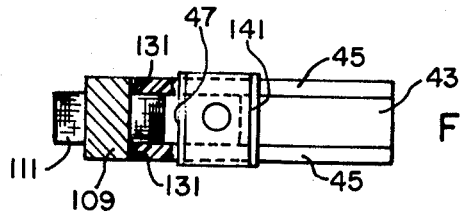
FIG. 6 is a horizontal sectional view taken on the line VI—VI of FIG. 4.
Figure 7:
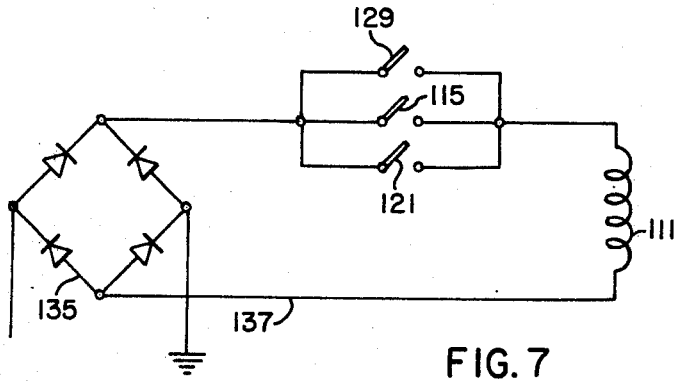
FIG. 7 is a circuit diagram.

As shown more particularly in FIG. 6, when the keeper 47 is latched, most of the permanent magnet flux passes through it from one pole to the other. However, there is an alternate path through the keeper 109 which has a higher reluctance by placing spacers 131 (FIG. 6) of insulation material, such as mylar, between the pole pieces 45 and the keeper 109. When the coil 111 is energized, it effectively lowers the holding force by setting up a magnetic field in the opposite direction to that supplied by the magnet, thereby releasing the keeper 47. This mechanism has a potentially very fast tripping ability, but it is limited by the inertia of the contact arm 27 and the amount of energy that must be stored in a spring 133 to provide the required acceleration. The flux transfer coil 111 is energized by closing contacts 121, 123 of the electromagnetic structure 107 or the contacts 115, 118 of the bimetal element 105 as shown in FIG. 7. A supply voltage passes through a full bridge rectifier 135 to lead wires 137. The contacts 115, 118 and 107, 121, and a switch 129, actuated either remotely or by a manual pushbutton 130, are connected in parallel so that any one may be closed to trip the breaker through the coil 111. Inasmuch as the bimetal element 105 and the electromagnetic structure 107 do not provide any direct unlatching in the device, but merely close contacts, they can be reduced in size and mass in order to increase the speed of operation considerably.

A keeper 134 (FIG. 4) is spring mounted so that it normally does not make contact with the pole pieces 45 of the flux transfer device. However, when the rod 136 connected to the keeper is depressed, it shunts some of the magnetic flux and since the keeper 47 is spring loaded it is released thereby to open the breaker. Thus, a manual trip or opening mechanism is provided for the breaker. The device is reset by depressing a reset button 139 which extend through the opening 57 of the housing portion 55 when the device is in the open circuit condition.

Inasmuch as the reset mechanism including the pushbutton 136 and keeper 134 do not enable closing it on a fault, another keeper 141 (FIG. 6) is provided. The keeper 141 is mounted on the keeper 47 which when latched, stores most of the energy for tripping the spring 133. The keeper 47 is reset first by a lever mechanism (not shown), then keeper 141 is reset, and requires only a small holding force (approximately 6 lbs. for 100 ampere breaker). If a large fault current occurs keeper 141 is released first as the contact arm 93 is driven by the yoke or magnetic slot motor 59. For lower fault currents keeper 47 is released first and carries the keeper 14 as well as the contact arm 93 with it.

Accordingly, the device of this invention provides for a number of advantages including potentially lower let through current and energy loss, a larger number of operations with high current faults than can be achieved with a single break device, more efficient use of the yoke material in developing the driving force, and the rate of rise of arc voltage is increased for the same acceleration of the contact arm in a single break device. Finally, the breaker has a potential of a peak interrupting capacity of 100,000 R.M.S. amperes symmetrical and by integrating the breaker and current limiting attachment into a single device there is considerable cost advantage and reduction in overall size.

What is claimed is:

1. A circuit interrupter protective device for responding to abnormal currents in the conductors of an electrical distribution system, comprising a housing, a circuit interrupter structure supported in said housing and comprising a pair of stationary contacts, moveable contacts cooperable with said stationary contacts, a briding contact arm carrying said movable contacts, support means supporting said contact arm for generally rectilinear, movement between closed and open positions, a magnetic drive structure comprising a magnetic device of magnetic material having an open slot therein open at one end thereof and closed at the other end thereof, said contact arm being positioned in said slot in proximity to the open end of said slot, said support means including movable means for moving said contact arm to the closed position, the circuit through said circuit interrupter passing through said contact arm and said contacts in the closed position of said contact arm, and upon the occurrence of an overload current above a predetermined value through said contact arm the magnetic flux generated by said current in said contact arm operating in said magnetic device to drive said contact arm into said slot toward the closed end of said slot to therefore open said contacts.

2. The device of claim 1 in which the support means comprises biasing means for holding said contact arm into the closed position.

3. The device of claim 1 in which said contact arm is an elongated member and is for limited pivotal movement mounted on said support means.

4. The device of claim 3 in which said magnet drive structure comprises a plurality of laminations of plates of magnetic material, and said contact arm being movable by said movable means in said slot between the open and closed ends thereof.

5. The device of claim 4 in which latch means are provided for latching said contact arm in the closed position.

6. The device of claim 5 in which the latch means comprises a magnetic flux producing structure for holding the contact arm in the closed condition, and the force of the magnetic structure being greater than the force exerted by the magnetic drive structure below overload current of said predetermined value.

7. The device of claim 5 in which there are release means to release said latch means.

8. A circuit interrupter protective device for responding to abnormal currents in the conductors of an electrical distribution system, comprising a housing, a circuit interrupter structure supported in said housing and comprising a pair of spaced stationary contacts, movable contacts cooperable with said stationary contacts, a contact arm carrying the movable contacts, support means supporting said contact arm for movement between closed and open positions, the support means being located substantially centrally between the spaced stationary contacts, a magnetic drive structure comprising a magnetic device of magnetic material and having an open slot therein open at one end thereof, and closed at the other end thereof, said contact arm being positioned in said slot in proximity to the open end of said slot, said support means comprising movable means for moving the contact arm to the closed position, the circuit through said circuit interrupter passing through said contact arm and said contacts in the closed position of said contact arm, and upon the occurrence of an overload current above a predetermined value through said contact arm the magnetic flux generated by said current in said contact arm operating in said magnetic device to drive said contact arm into said slot toward the closed end of said slot to thereby open said contacts.

9. The device of claim 8 in which said contact arm is mounted for limited pivotal movement on the support means.

10. The device of claim 8 in which said support means comprises first biasing means biasing said contact arm in the closed position.

11. The device of claim 9 in which the magnetic drive structure comprises a plurality of laminations of plates of magnetic material, and said contact arm being movable by said movable means in said slot between the open and closed ends thereof.

12. The device of claim 11 in which latch means are provided for latching the contact arm in the closed position.

13. The device of claim 12 in which the latch means comprise a magnetic flux producing structure comprising a permanent magnet, said magnetic flux producing structure being supported within said housing and disposed about said movable means to produce magnetic force which acts upon said movable means to hold said contact arm in a closed position, the force produced by said magnetic flux producing structure being greater than the force exerted by said magnetic drive structure below overload current of said predetermined value and being less than the force exerted by said magnetic drive structure at or above overload current of said predetermined value.

14. The device of claim 13 in which said latch means comprise second biasing means disposed about said movable means and acting upon said movable means for accelerating movement of the contact arm to the open position upon the movement of said contact arm into said slot.

15. The device of claim 13 in which current responsive trip means connected to one of said conductors, the magnetic flux-producing structure comprising a magnet, a first keeper, a second keeper, and a coil around said second keeper, the first keeper being attached to said support means, and the coil being connected to said current responsive trip means.

16. The device of claim 15 in which the current responsive trip means comprises a bimetal element.

17. The device of claim 15 in which the current responsive trip means comprises an electromagnetic trip.

* * * * *